US007300495B2

(12) United States Patent
Taylor

(10) Patent No.: US 7,300,495 B2
(45) Date of Patent: Nov. 27, 2007

(54) UTILIZATION OF HIGH PERMEABILITY FILTER FABRICS TO ENHANCE FABRIC FILTER PERFORMANCE AND RELATED METHOD

(75) Inventor: Robert W. Taylor, Kansas City, MO (US)

(73) Assignee: General Electric Company, Schenectady, NY (US)

( * ) Notice: Subject to any disclaimer, the term of this patent is extended or adjusted under 35 U.S.C. 154(b) by 113 days.

(21) Appl. No.: 11/235,123

(22) Filed: Sep. 27, 2005

(65) Prior Publication Data

US 2007/0068384 A1 Mar. 29, 2007

(51) Int. Cl.
*B03C 3/28* (2006.01)

(52) U.S. Cl. ..... 95/57; 95/70; 96/63; 96/66; 96/98; 110/216; 110/345

(58) Field of Classification Search ..... 96/55, 96/59, 66, 98, 15, 63; 95/63, 70, 57; 110/216, 110/345
See application file for complete search history.

(56) References Cited

U.S. PATENT DOCUMENTS 3,577,705 A * 5/1971 Sharlit ..... 95/2
3,733,784 A * 5/1973 Anderson et al. ..... 96/43
3,915,676 A * 10/1975 Reed et al. ..... 96/32
3,966,435 A * 6/1976 Penney ..... 96/66
5,024,681 A * 6/1991 Chang ..... 95/70
5,059,219 A * 10/1991 Plaks et al. ..... 96/77
5,158,580 A * 10/1992 Chang ..... 95/70
5,217,511 A * 6/1993 Plaks et al. ..... 96/55
5,403,383 A * 4/1995 Jaisinghani ..... 95/69
6,152,988 A 11/2000 Plaks et al. ..... 95/58
6,514,315 B1 2/2003 Chang ..... 95/70
6,544,317 B2 4/2003 Miller ..... 95/63

OTHER PUBLICATIONS

"Max-9—Electrostatic Fabric Filter: What is Max-9?" TAPC, www.tapc.com.au/eletrostatic/max9.html, Mar. 8, 2005.
"Max 9—Electrostatic Fabric Filter: How it works," BHA Group, Inc., www.bha.com/max9, Mar. 23, 2005.

* cited by examiner

*Primary Examiner*—Richard L. Chiesa
(74) *Attorney, Agent, or Firm*—Nixon & Vanderhye, PC

(57) ABSTRACT

A flue gas treatment system for a fossil-burning power plant having a fuel source and a boiler includes a barrier filter downstream of the boiler, the barrier filter including an electrostatically-stimulated fabric filter utilizing high-permeability fabric, having an air permeability of at least 75 acfm/sq.ft. A method of treating flue gas includes generating a flue gas; and passing substantially 100% of the flue gas from a boiler directly through an electrostatically-stimulated fabric filter incorporating high-permeability fabric with an air permeability of at least 75 acfm/sq.ft.

8 Claims, 2 Drawing Sheets

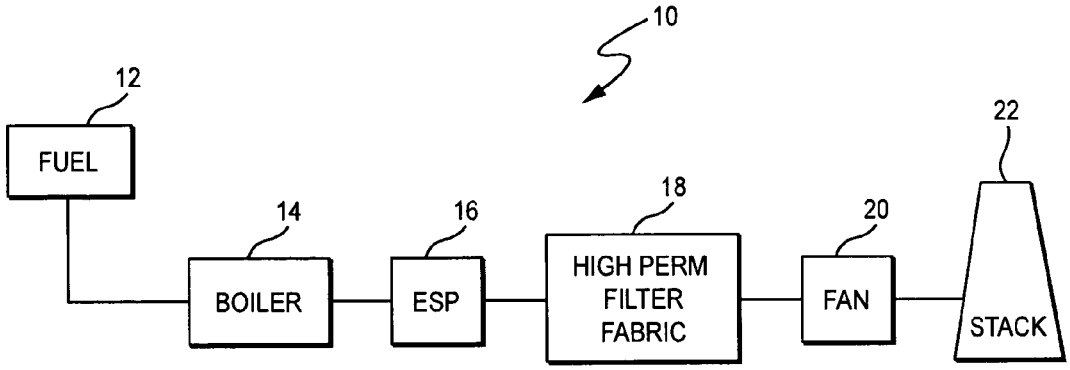
*Fig. 1* *(Prior Art)*
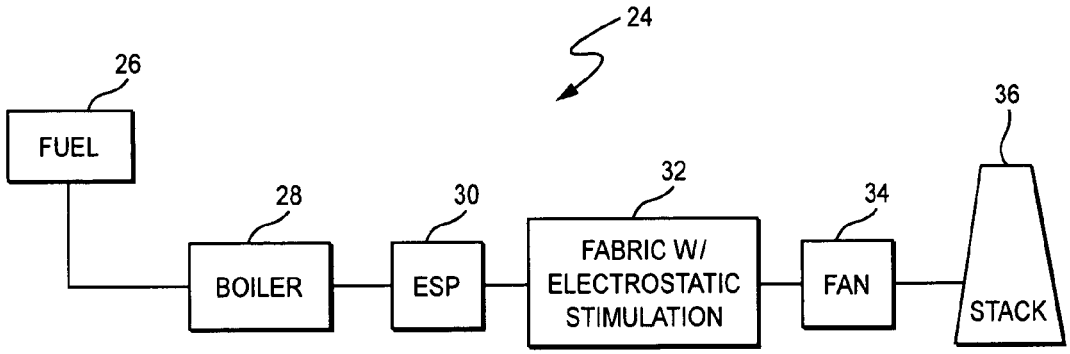
*Fig. 2* *(Prior Art)*

UTILIZATION OF HIGH PERMEABILITY FILTER FABRICS TO ENHANCE FABRIC FILTER PERFORMANCE AND RELATED METHOD

BACKGROUND OF THE INVENTION

This invention relates to the control of emissions from fossil-burning power plants, and, more specifically, to an electrostatically-stimulated fabric filter utilized in a flue gas treatment system.

Flue gas treatments used in conjunction with fossil-fuel power generation plants often employ fabric barrier filters to remove particulates from the flue gas before the gas is exhausted through a stack to atmosphere. Fabric barrier filters include baghouses of the pulse-jet type and reverse flow or shake-deflate type for periodically removing the dust cake accumulated on the surface of the bag filter. The fabric bag filters typically have a permeability of 25 to 50 acfm/sq.ft (actual cubic feet per minute of air flow per square foot of filter surface area at a pressure drop of one half inch water or greater). Examples of conventional fabrics used in such filters include PPS and TEFLON®/glass. These fabrics, however, can experience high pressure drop problems when applied at high air to cloth ratios, when installed downstream of an electrostatic precipitator, or when experiencing heavy inlet dust burden. Fans are typically employed to overcome the additional pressure drop required to draw the flue gas across the barrier filter. The operating cost of a fabric filter is heavily dependent on the system pressure drop experienced. Operating costs associated with a fabric filter can be reduced by lowering system pressure drop. The number of cleaning cycles imposed on a fabric filter impacts expected useful life of the bag. In addition, if the fabric filter system can operate with a reduced number of cleaning cycles, bag life can be extended.

High-permeability fabric filter bags have also been used and generally reduce pressure drop. A high-permeability fabric filter bag is disclosed in U.S. Pat. No. 6,514,315 that is said not to have the high pressure drop problems associated with conventional fabric filters. High permeability fabric filters have permeabilities higher than 76 and up to 200 acfm/sq.ft. Of concern, however, is the higher emissions experienced with such high permeability fabrics.

In another recent development, a dust collection system combines Discharge Electrodes and fabric filters in the same casing. This arrangement has been characterized as an electrostatic precipitator that uses fabric filters instead of collection plates. Such electrostatically-stimulated filters have been used as slipstream units to augment existing dust collectors, as polishing units behind existing precipitators, baghouses or scrubbers, or as a stand-alone high efficiency precipitator. To the best of our knowledge, these units use only conventional fabric filters.

There remains a need, therefore, to create a filter barrier of high permeability for reduced pressure drop, but that does not also result in higher emissions.

BRIEF DESCRIPTION OF THE INVENTION

In an exemplary embodiment of the invention, there is provided a flue gas treatment system that combines features of known high-permeability fabric filter arrangements and electrostatically stimulated filters. More specifically, the exemplary embodiment described herein utilizes an electrostatically stimulated filter that incorporates a high-permeability filter fabric, with a permeability of at least 75 acfm/sq.ft. This arrangement results in lower pressure drop but without sacrificing particulate collection efficiency.

Accordingly, in one aspect, the invention relates to a flue gas treatment system for a fossil-burning power plant having a fuel source and a boiler, the system comprising a barrier filter downstream of the boiler, the barrier filter comprising an electrostatically-stimulated fabric filter utilizing high-permeability fabric, having an air permeability of at least 75 acfm/sq.ft.

In another aspect, the invention relates to a flue gas treatment system comprising a combustor supplied with fuel from a fuel source; an electrostatic precipitator positioned downstream of the combustor; and a barrier filter downstream of the boiler, the barrier filter comprising an electrostatically-stimulated fabric filter utilizing high-permeability fabric, having an air permeability of at least 75 acfm/sq.ft.

In still another aspect, the invention relates to a method of treating flue gas comprising generating a flue gas; and passing the flue gas through a barrier filter comprising an electrostatically-stimulated fabric filter incorporating high-permeability fabric with an air permeability of at least 75 acfm/sq.ft.

The invention will now be described in detail in connection with the drawings identified below.

BRIEF DESCRIPTION OF THE DRAWINGS

FIG. 1 is a schematic diagram of a conventional flue gas treatment system;

FIG. 2 is a schematic diagram of another conventional flue gas treatment system;

DETAILED DESCRIPTION OF THE INVENTION

Figure 3:
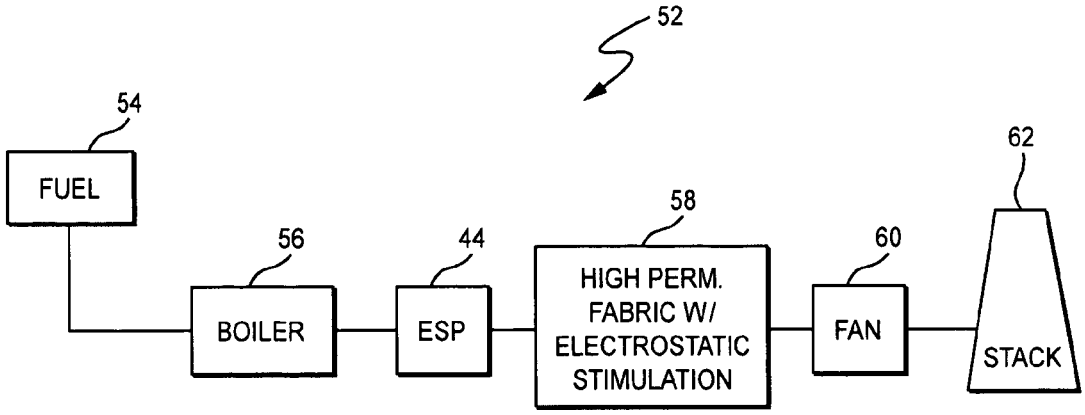
FIG. 3 is a schematic diagram of a flue gas treatment system in accordance with an exemplary embodiment of this invention.

FIG. 1 illustrates a conventional and simplified flue gas treatment system 10. Fuel from a source 12 is burned in a boiler 14 of the type typically used in fossil-burning power plants. The fuel may be, for example, coal or oil, with combustion gases (flue gases) exiting the boiler and passing through an electrostatic precipitator (ESP) 16. If utilized, the ESP charges and collects flue gas particles on electrodes within the ESP. The ESP may remove up to 90-99% of the flue gas particles.

The flue gas is subsequently delivered to a barrier filter 18 that may include baghouses of, for example, the pulse-jet type that may incorporate high permeability fabric filters as described in U.S. Pat. No. 6,514,315. A fan 20 facilitates movement of the flue gas through the filter 18 to the stack 22 from which the flue gases are emitted to atmosphere. Use of high-permeability fabric with a permeability of at least 75 and up to 200 acfm/sq.ft. reduces pressure drop, but also disadvantageously increases emissions, particularly in pulse-jet type filters.

FIG. 2 illustrates a similar flue gas treatment arrangement, again including a fuel source 26, boiler 28, ESP 30, fan 34 and stack 36. In this case, however, the high permeability fabric filter has been replaced by an electrostatic barrier filter 32. More specifically, the fabric barrier filter 32 is comprised of an electrostatically-stimulated fabric filter that may be of the type sold under the trade name "Max-9" from BHA Technologies, Inc. (a wholly-owned subsidiary of the assignee) and as described in U.S. Pat. No. 6,152,988. These units are said to result in a 60-80% reduction in static pressure across fabric filters. In these filter arrangements, however, conventional filter barrier fabrics (permeability of 25-50 acfm/sq.ft.) are employed and, thus, pressure drop and emissions results are not entirely satisfactory.

FIG. 3 is a simplified flow diagram of a flue gas treatment in accordance with an exemplary embodiment of this invention. The system or plant 38 again includes a fuel source 40, boiler (or other combustor) 42, an optional ESP 44, fan 48 and stack 50. In this case, however, an electrostatically-stimulated fabric filter 46 of the "Max-9" type is employed, but incorporating a high-permeability fabric of the type used in the embodiment shown in FIG. 1. The high permeability fabric has an air permeability greater than 75 (for example, 100, and up to 200) acfm/sq.ft.

In the "Max-9" unit, discharge electrodes serve to ionize (charge) the dust, which is then collected on the surface of the fabric filter. Since the dust particles are charged to the same polarity, they repel each other, making the dustcake more porous. The charge also makes the dust easier to remove from the filter.

Figure 4:
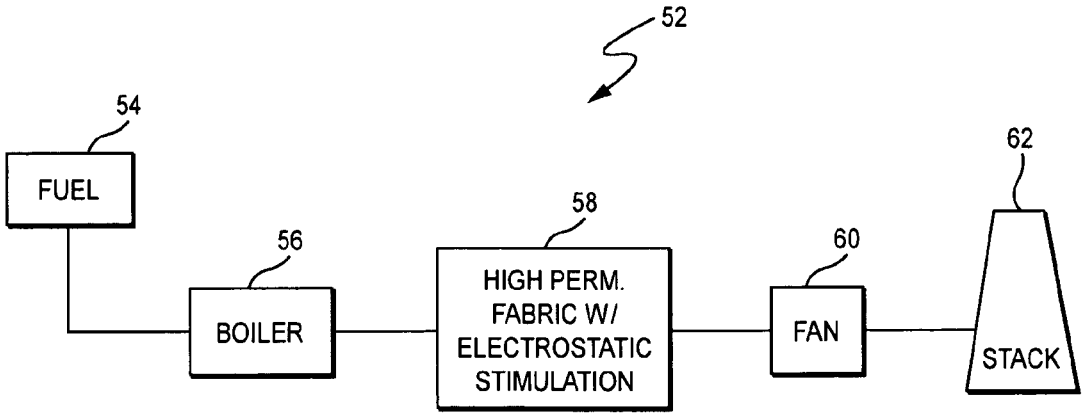
FIG. 4 is a schematic diagram of a flue gas treatment system in accordance with another exemplary embodiment of this invention.

Turning to FIG. 4, an alternative arrangement within the scope of the invention is illustrated. Here, the plant 52 includes a fuel source 54, boiler (or other combustor) 56, an electrostatically-stimulated fabric filter 58, fan 60 and stack 62. This arrangement is similar to that shown in FIG. 3, but without the ESP 44. Now, 100% of the flue gas volume enters the filter 58 directly from the boiler 56.

These arrangements have led to reduced pressure drop and, unexpectedly, with no increase in emissions. Stated otherwise, the flue gas treatment of this invention provides lower system pressure drop while maintaining high particulate removal efficiency. Apparently, the filter mechanism or barrier created by the presence of the electrical field provides the ability to operate at low pressure while maintaining high efficiency particulate removal.

Add FIG. 4 relating a system with no ESP and 100% of the gas volume entering the ESFF. (See attached sketch)

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A flue gas treatment system for a fossil-burning power plant having a fuel source and a boiler, the system comprising a barrier filter downstream of the boiler, said barrier filter comprising an electrostatically-stimulated fabric filter utilizing high-permeability fabric, having an air permeability of at least 75 acfm/sq.ft., said barrier filter arranged to receive substantially 100% of flue gas volume directly from said boiler.

2. The flue gas treatment system of claim 1 wherein said high permeability fabric has an air permeability of between 75-200 acfm/sq.ft.

3. The flue gas treatment system of claim 1 wherein said high-permeability filter fabric has an air permeability of about 100 acfm/sq.ft.

4. The flue gas treatment system of claim 3 including a fan downstream of said barrier filter and upstream of an exhaust stack.

5. The flue gas treatment system of claim 1 including a fan downstream of said barrier filter and upstream of an exhaust stack.

6. A method of treating flue gas comprising generating a flue gas; and passing substantially 100% of the flue gas from a boiler directly through a barrier filter comprising an electrostatically-stimulated fabric filter incorporating high-permeability fabric with an air permeability of at least 75 acfm/sq.ft.

7. The method of claim 6 wherein said high permeability fabric has an air permeability of between 75-200 acfm/sq.ft.

8. The method of claim 6 wherein said high-permeability filter fabric has an air permeability of about 100 acfm/sq.ft.

* * * * *